US009394037B1

(12) United States Patent
Schitzhofer

(10) Patent No.: US 9,394,037 B1
(45) Date of Patent: Jul. 19, 2016

(54) SPORT BOARD WITH ADJUSTABLE FLEXURAL STRENGTH

(71) Applicant: Franz Schitzhofer, Graz (AT)

(72) Inventor: Franz Schitzhofer, Graz (AT)

( * ) Notice: Subject to any disclaimer, the term of this patent is extended or adjusted under 35 U.S.C. 154(b) by 0 days.

(21) Appl. No.: 14/477,136

(22) Filed: Sep. 4, 2014

(51) Int. Cl.
*B63B 35/79* (2006.01)
*B63B 35/85* (2006.01)

(52) U.S. Cl.
CPC ..... *B63B 35/7909* (2013.01); *B63B 35/79* (2013.01); *B63B 35/85* (2013.01)

(58) Field of Classification Search
CPC ..... B63B 1/00; B63B 35/79; B63B 35/7906; B63B 35/7916; B63B 35/7933; B63B 45/04
USPC ..... 441/65, 70, 74; 114/355, 357
See application file for complete search history.

(56) References Cited

U.S. PATENT DOCUMENTS

| | | | | |
|---|---|---|---|---|
| 6,036,560 | A * | 3/2000 | Pekar | 441/65 |
| 7,347,754 | B1 * | 3/2008 | Cheung | 441/65 |
| 7,938,705 | B2 * | 5/2011 | Fitzgerald | 441/74 |
| 8,272,907 | B2 * | 9/2012 | Lindstrom | 441/74 |
| 8,292,681 | B2 * | 10/2012 | Duff et al. | 441/65 |
| 8,323,064 | B2 * | 12/2012 | Lessing | 441/65 |

* cited by examiner

*Primary Examiner* — Lars A Olson
(74) *Attorney, Agent, or Firm* — Mark D. Bowen; Malin Haley DiMaggio & Bowen, P.A.

(57) ABSTRACT

The present invention describes a Sports board 1, preferably a kiteboard or a wakeboard with adjustable flexural strength. The sports board 1 includes a tensioning apparatus 10 which is arranged between two foot straps 2 mounted on an upper surface 1*a* of the sports board 1. The tensioning device 10 consists at least of a central actuating device 11 and at least one tensioning element 12 which extends from the actuating device 11 to both of the foot straps 2, wherein the tensioning element (12) is connected either with the upper surface 1*a* of the sports board 1 near the foot straps 2, or with the foot straps 2. A tension on the at least one tensioning element 12 is varied by the actuating device 11.

15 Claims, 12 Drawing Sheets

SPORT BOARD WITH ADJUSTABLE FLEXURAL STRENGTH

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates to a sports board, preferably a kiteboard or wakeboard with adjustable flexural strength. In particular, the flexural strength of the sports board is adjustable by the rider himself and even during the use of the sports board.

2. Description of Related Art

It is well known to produce various sports boards, in particular various kiteboards, having different flexural strength for different conditions and purposes. A lower flexural strength causes a higher flexure of a kiteboard and vice versa. The term "flexure" refers to a bending property of the kiteboard or a sports board in general.

A kiteboard with a higher flexure is preferably used for normal riding on the water. Due to the resulting lower flexural strength a pounding of the waves is better attenuated, and the kiteboard, which is bent flat by the weight of the rider, obtains better contact with the water surface and thus starts skimming sooner. A kiteboard with a lower flexure is preferably used for jumps, because the higher flexural strength of the kiteboard facilitates the take-off. Furthermore, a kiteboard with a lower flexure provides racier driving characteristics, which is particularly advantageous for maneuvers such as tacking and jibing.

It is also known from the prior art to construct a sports board, in particular a kiteboard, in such way that its flexural strength is variable.

For instance, a sheet-like body is attached to the top of the kite board, which is arranged movable in the longitudinal direction of the kite board. In a first operating mode "Ride" the sheet-like body slides loose on the kiteboard. In a second operating mode "Jump" the sheet-like body connects firmly with the kiteboard by means of a blocking device, which increases the flexural strength of the kiteboard. This facilitates a transition from flexible to rigid depending on the current operating status of the kiteboard.

However, all approaches known from the prior art to vary the flexural strength of a kiteboard are complicated, material-consuming and fail to facilitate an easy adjustment of the flexural strength by the rider, preferably during the use of the sport board.

Therefore, it is an object of the present invention to improve the known prior art. In particular, it is an object of the present invention to provide a sports board, whose flexural strength can be adjusted by the rider in a simple and quick manner. The invention shall give the rider the possibility to respond quickly to changing conditions and to adjust the flexural strength of the kiteboard while using same. It is a further object of the present invention to construct a sports board with adjustable flexural strength in a cheaper way and with less material. It is also an object of the invention to provide a sports board with adjustable redirection. It is a further object of the present invention to provide a sports board with a device for adjusting the flexural strength, which in the case of a defect can be repaired easily.

The above-mentioned objects are achieved by the subject matter of the independent claim of the present invention. The dependent claims further develop the central idea of the present invention in an advantageous manner.

BRIEF SUMMARY OF THE INVENTION

In particular, the present invention relates to a sports board, preferably a kiteboard or wakeboard, with an adjustable flexural strength, comprising a tensioning device arranged between two foot straps, wherein the foot straps are attached on an upper surface of the sports board, the tensioning device comprising: a central actuating device, and at least one tensioning element extending from said actuating device to both of the foot straps, wherein the tensioning element is connected either with the upper surface of the sports board near the foot straps, or with the foot straps, wherein a tension on the at least one tensioning element is adjustable by means of the actuating device.

The tension on the at least one tensioning element can be varied by actuating the actuating device by the rider. This variation in tension is transmitted to the upper surface of the sports board. As a result, the flexural strength and the flexure of the sports board can be adjusted depending on the tension on the at least one tensioning element. The sports board can thus be adapted to changing conditions. In addition to the flexural strength of the sports board the rocker of the sports board is varied by a variation in tension on the at least one tensioning element. The term "rocker" denotes a redirection of the sports board. The rocker significantly influences the riding characteristics of the sports boards. Even during use of the sports boards the actuating device is easily accessible for the rider of the sports board, because it is located between the two foot straps. The tensioning device can be constructed very simple and is therefore inexpensive. The entire tensioning device is limited to the area between the two foot straps and is therefore constructed relatively compact.

For example, the rider can actuate the actuating device continuously in order to vary the flexural strength of the sports board continuously. However, preferably, the actuating device has a preset number of clearly defined actuating steps. Thus, the rider is given the possibility to selectively adjust the flexural strength of the sports board to two or three clearly defined levels or relative levels. For example, the sports board can be adjusted to three levels, namely "soft", "normal" and "rigid", in order to adapt said board to changing conditions and various applications. This allows the rider an extremely simple handling of the sports boards with adjustable flexural strength.

In one embodiment, the at least one tensioning element can be tensioned along its extension direction by means of the actuating device, wherein the actuating device comprises at least one turnbuckle or cable tensioner.

Such a tensioning device with a turnbuckle or cable tensioner is a particularly simple construction. Preferably, the two foot straps are connected to the at least one tensioning element which in turn can be tensioned by the turnbuckle or cable tensioner. Alternatively, the tension on the at least one tensioning element can be created by means of a lever (similar to a buckle of a ski boot), with a ratchet and a toothed band, or by means of a strap and a clamp or ratchet (similar to a lashing strap for load fastening to the roof of a car).

In one embodiment, the at least one tensioning element can be tensioned along its extension direction by means of the actuating device, wherein the actuating device comprises a toothed band and a ratchet.

In one embodiment, the actuating device is rotatable such that the at least one tensioning element can be rotated around its extension direction, and the tension on the at least one tensioning element is adjustable by rotating the actuating device.

Through the rotation of the at least one tensioning element its length varies. Preferably, two tensioning elements are rotated by the actuating device against each other. The tension on the tensioning elements is increased by the resulting length reduction of the tensioning elements, and said tension is transferred to the sports board. This embodiment is particularly simple to manufacture and can also be easily repaired by the rider in case of failure (for example, in the case of a defective tensioning element). For example, the at least one tensioning element may be a cable or rope as it is used in surfing or sailing. A substitute for such a tensioning element is available at any time.

Preferably, the actuating device can be locked at least in a plurality of positions, preferably rotary positions, or along the extension direction of the tensioning element. More preferably, the actuating device can be continuously locked.

Preferably, two or three lockable positions are given for the actuating device, preferably rotary positions, or positions along the extension direction of the tensioning element. These positions then correspond to defined levels of the flexural strength of the sports board, such as the above levels "soft", "normal" and "rigid".

In an embodiment where the actuating device is a toothed band with a ratchet, the locking is preferably effected by engaging of the ratchet into the indentation between two adjacent teeth of the toothed band. This results in up to 10, preferably 2-8, more preferably 3-7 and most preferably 5-6 lockable positions along the extension direction of the tensioning element, wherein the maximum number of positions is determined by the number of teeth of the toothed band.

In a further embodiment, a movable part of the actuating device is designed to vary its length in longitudinal direction of the sports board, at least one tensioning element extends from said movable part to each foot strap, and the tension on the at least two tensioning elements is adjustable by varying the length of the movable part.

Preferably, the actuating device comprises a turnbuckle mounted on two threaded rods, at least one tensioning element extends from each threaded rod to a foot strap, and the tension on the at least two tensioning elements is adjustable by turning the turnbuckle.

In this embodiment, the rider can easily adjust the flexural strength of the sports board by turning the turnbuckle. Therefore, the turnbuckle can be jacketed by a handle, or be connected to or integrated into a handle ("grab handle") of a sports board. Again, predefined, lockable rotary positions can be given for the turnbuckle. However, also in this embodiment it is possible to adjust the flexural strength of the sports board continuously.

According to a particularly preferred embodiment, the actuating device comprises a toothed band and a ratchet, at least one tensioning element extends from the toothed band to a foot strap, at least a further tensioning element extends from the ratchet to a further foot strap, and the tension on the at least two tensioning elements is adjustable by actuating the ratchet, for example by means of a buckle.

As referred to herein, a "toothed band" preferably is an elongated material band manufactured from plastic or metal, which has on its upper surface elongated indentations running at regular intervals substantially parallel to one another and transversely to the longitudinal extension of the band, such that in the longitudinal section of the toothed band a regularly toothed profile is obtained.

As used herein, a ratchet preferably is a locking element, which is preferably manufactured from plastic or metal. This locking element engages in the indentations between two teeth of the toothed band, thus locking the toothed band in its direction of movement, preferably in the direction of its longitudinal extension, most preferably in the extension direction of the tensioning element.

In a preferred embodiment, the ratchet is designed as an elongated material band, wherein one end of the band is movably connected to a buckle via a connecting joint, preferably such that the buckle can be lifted and lowered again. In this embodiment the ratchet and the toothed band are moved and locked by actuating the buckle.

Therein, the buckle which is connected with the ratchet is in contact with the toothed band, preferably in such way that the ratchet is moved in the opposite direction of the toothed band when the buckle is lifted and lowered (similar to the buckle of a ski boot or the ratchet band of a soft snowboard binding). Thus, the length of the entire actuating device in the longitudinal direction of the sports board is reduced, thereby increasing the tension on the at least one tensioning element.

In this embodiment, the rider can easily adjust the flexural strength of the sports board to one or multiple levels by actuating the ratchet, for example by lifting and lowering the buckle once or several times. Pre-defined, lockable positions for the ratchet can be provided by an appropriate design of the toothed band, i.e. by adjusting the distances between the indentations between the teeth. However, also in this embodiment the flexural strength of the sports board may be adjusted continuously, for instance by use of a strap or a plane band instead of the toothed band.

Preferably, the turnbuckle and the threaded rods, or the toothed band and the ratchet, are held above the upper surface of the sports board by at least one holding device, preferably 1-10 cm, more preferably 2.5-6 cm above the upper surface of the sports board.

The elevation of the actuating means above the upper surface of the sports board facilitates the actuation of the tensioning device by the rider.

Preferably, the actuating device is jacketed with a handle, or connected to or integrated into the handle ("grab handle") of a sports board.

In case that the actuating device comprises a toothed band and a ratchet, then these are preferably integrated into a longitudinal cavity of the handle so that the rider retains full access to the actuating device and especially to the ratchet, while the risk of injury by protruding parts is minimized.

In a further preferred embodiment, the ratchet is fixedly connected to the holding device. Thus, the position of the ratchet is retained during actuation of the actuating device. This facilitates handling of the ratchet.

In a further preferred embodiment, the toothed band is connected to the at least one tensioning element by means of a tensioning band, or the ratchet is connected to the at least one tensioning element by means of a tensioning band, or the toothed band and the ratchet are each connected with the respective at least one tensioning element by means of a particular tensioning band, preferably wherein the tensioning band is connected to the at least one tensioning element via at least one redirection element.

A tensioning band may be inelastic or elastic, and in particular be a cable or rope, which consists, for example, of natural fibers such as hemp or synthetic fibers, such as Dyneema.

In a particularly preferred embodiment, the respective at least one tensioning band is connected to the respective at least one tensioning element via at least one redirection element. Preferably, the redirection element is designed such that starting from the toothed band or the ratchet, respectively, the tensioning band can be led through or passed around the redirection element.

In one embodiment, the at least one redirection element is shaped as a ring, and may be for example a metal ring or plastic ring. This ring can be connected to the tensioning element, for example by means of a knot or loop.

In an embodiment wherein the at least one tensioning element is bent at the actuating device and connected at two points either with the upper surface of the sports board or with the foot strap, and wherein the two points are arranged relative to each other in the transverse direction of the sports board, the tensioning element is preferably led through the ring-shaped redirection element, thereby connecting the tensioning element to the redirection element.

In an embodiment wherein the tensioning element is completely or at least partially made of plastic, the redirection element is preferably formed as an integral part of the tensioning element. According to a particularly preferred embodiment, the toothed band and the ratchet are connected to the respective at least one tensioning element by means of a tensioning band, wherein the tensioning band is formed as a loop, which interconnects the toothed band and the ratchet.

Preferably, one end of the tensioning band is connected to the toothed band and the other end of the tensioning band is connected to the ratchet. In this embodiment, the tensioning band preferably extends from the toothed band on the one side, and from the ratchet on the other side, in the direction of the respective tensioning element, and is on either side led through or passed around a redirection element. Consequently, the actuating device is connected to the tensioning elements via a loop-shaped tensioning band and two redirection elements.

This embodiment of the present invention advantageously allows that the ratchet can be fixedly connected to the holding device, for example by screwing, gluing or by an integral construction. On actuation of the ratchet, for example by means of a buckle, the tensioning band shortens, thereby increasing the tension on the tensioning elements. The redirection elements act as double hoist, which facilitates actuation of the ratchet, and reduces the forces acting on the ratchet band.

In addition to the elevation of the actuating device above the upper surface of the sports board, this embodiment further facilitates actuation of the tensioning device by the rider. In a further embodiment, a movable part of the actuating device is designed to vary its height above the upper surface of the sports board, at least one tensioning element extends from said movable part to each foot strap, and the tension on the at least two tensioning elements is adjustable by varying the height of the movable part.

In a first variant of this embodiment an air cushion is arranged between the upper surface of the sports board and the movable part, wherein the height of the movable part on the upper surface of the sports board is adjustable by introducing air into the air cushion or releasing air from the air cushion.

This variant enables the rider to easily vary the flexural strength of the sports board by introducing air into the air cushion or releasing air from the air cushion. The advantage of this variant is that no metallic parts must be used, which, for example, improves the resilience of the sports board against salt water and increases its life span. The first variant can also be produced particularly cost-effective.

In a second variant of the embodiment, the actuating device comprises a screwing device, which is screwed into the upper surface of the sports boards, at least one tensioning element extends from the screwing device to each foot strap, and the tension on the at least two tensioning elements is adjustable by turning the screwing device.

In each of the embodiments described above it is preferred that at least two tensioning elements extend to each foot strap and are connected at two points either with the upper surface of the sports board or with the foot strap, or at least one tensioning element which is turned at the actuating device extends to each foot strap and is connected at two points either with the upper surface of the sports board or with the foot strap, wherein the two points are placed offset from each other in the transverse direction of the sports board.

A triangular area is spanned between the two points that are arranged relative to each other in the transverse direction of the sports board and the additional point where the tensioning element is connected to or bent at the actuating device, respectively. This construction allows varying not only the flexural strength of the sports board, but also its torsional stiffness, by actuating the actuating device.

It is further preferred that the actuating device is arranged approximately in the middle of the transverse direction of the sports board. It is also preferred that the sports board comprises a handle attached to its upper surface, wherein the handle carries or incorporates the actuating device. Furthermore, it is preferred that the at least one tensioning element is designed such that the tension on the at least one tensioning element can be tensile stress and/or shear stress.

The flexure of the sports board can be increased both by shear and by tensile stress. In addition, the absolute curvature of the sports board can be adjusted accordingly. By increasing the shear stress on the at least one tensioning element, for example the curvature of the sports board in longitudinal direction is reduced. By increasing the tensile stress on the at least one tensioning element, for example the curvature of the sports board in longitudinal direction is increased. It is also preferred that the at least one tensioning element is a rope and/or is made of plastic. It is further preferred that the actuating device and the at least one tension member are integrally formed from a plastic part.

For integral manufacture of the tensioning device, for example, a block can be produced whose edges approximately represent the tensioning elements and the actuating device, respectively. For weight reasons, any material may be omitted or removed from this block that is not essential in terms of stability or rigidity. The tensioning device integrally formed from a plastic block can be easily and quickly mounted on a sports board with adjustable flexural strength. Conventional sports boards can thus be retrofitted.

BRIEF DESCRIPTION OF THE SEVERAL VIEWS OF THE DRAWINGS

In the following, the present invention will be described with reference to the accompanying figures.

DETAILED DESCRIPTION OF THE INVENTION

Figure 1:
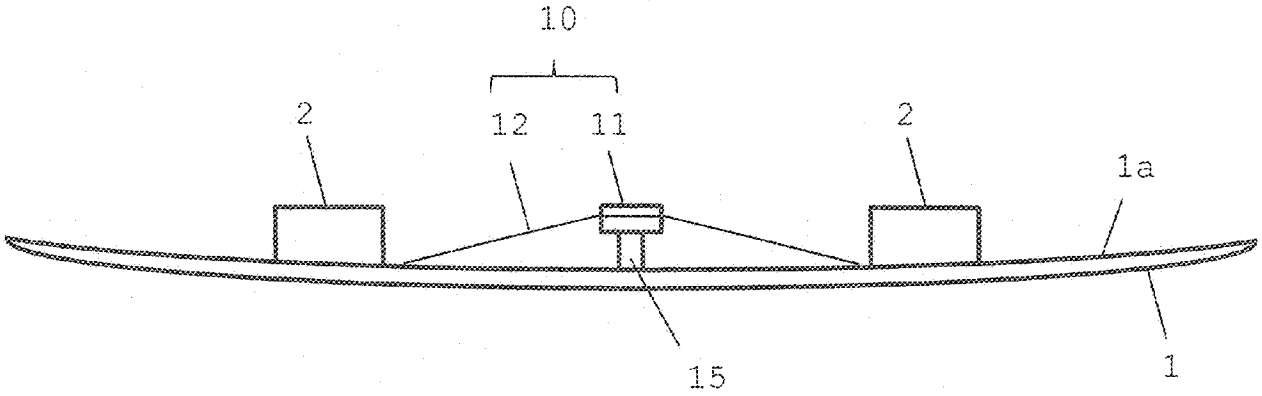
FIG. 1 shows a sports board according to an embodiment of the present invention.

FIG. 1 shows an embodiment of a sports board 1 of the present invention. The sports board 1 is preferably a kiteboard or wakeboard, but can also be a surfboard, windsurf board or snowboard. The sports board 1 has an upper surface 1*a*, which for example faces away from the water surface when riding. On the upper surface 1*a* of sports board 1 two foot straps are attached spaced apart from each other. The rider can step into these foot straps 2 in order to maneuver the sports board 1.

Between the two foot straps 2, a tensioning device 10 is attached on the upper surface 1*a* of the sports board 1, preferably centrally between the two foot straps 2. The tensioning device 10 comprises at least a tensioning element 12 and a central actuating device 11. The at least one tensioning element 12 extends from the central actuating device 11 in the direction of both foot straps 2. The at least one tensioning element 12 may be led through the actuating device 11, or may comprise two or more tensioning elements 12, which are each connected with one end to the actuating device 11. Those ends of the at least one tensioning element 12 at the far end of the actuating device 11 are exemplarily connected with the upper surface 1*a* of the sports board 1, as shown in FIG. 1.

On actuation, the actuating device 11 is suited to vary a tension, particularly a tensile stress and/or a shear stress, on the at least one tensioning element 12. This variation in tension is transmitted to the upper surface 1*a* of the sports board 1. Thus, a tensile force or shear force is exerted on the upper surface 1*a* of the sports board 1. For example, a deflection of the sports board 1 can be enhanced by increasing the tension on the at least one tensioning element 12, which leads to less flexure, and a higher flexural strength of the sports board 1. The deflection of the sports boards 1 corresponds to the rocker of the sports board 1. By increasing the shear stress on the at least one tensioning element 12, a deflection of the sports boards 1 can be attenuated, which also results in a lower flexure and a higher flexural strength of the sports board 1.

The actuating device 11 is preferably arranged in such way that it can be easily actuated by the rider of the sports board 1, in particular also while riding the sports board 1. Therefore, the actuating device 11 may be arranged in an elevated position over the upper surface 1*a* of the sports board 1 by means of a holding device 15, preferably 1-10 cm, more preferably 2-8 cm, most preferably 2.5-6 cm over the upper surface 1*a* of the sports board 1. The actuating device 11 may be further designed such that either the shear stress and/or tensile stress on the at least one tensioning element 12 can be continuously varied, or such that predefined settings for the shear stress and/or tensile stress, and therefore also for the flexural strength and the flexure of the sports board 1, can be selected.

Figure 2:
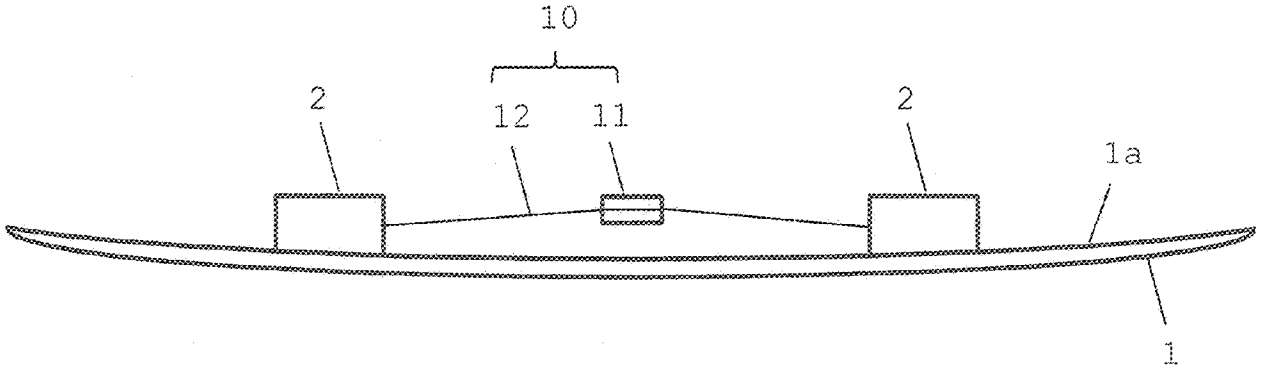
FIG. 2 shows a sports board according to another embodiment of the present invention.

FIG. 2 shows a further embodiment of the present invention, which largely corresponds to the first embodiment. In the further embodiment shown in FIG. 2, the at least one tensioning element 12 which extends to the two foot straps 2, is connected directly to each of the two foot straps 2. In this embodiment, the tensioning device 10 can for example consist of a tensioning element 12, which is spanned between the two foot straps 2, and an actuating device 11 that can tension or relax the tensioning element 12. The actuating device 11 may, for example, be a turnbuckle or cable tensioner, a ratchet or clamp, or may be a lever. The at least one tensioning element 12 can be a cable, which exemplarily consists of natural fibers such as hemp or synthetic fibers, such as Dyneema, or may be a strap, a tension belt, a rope, or the like.

Figure 3A:
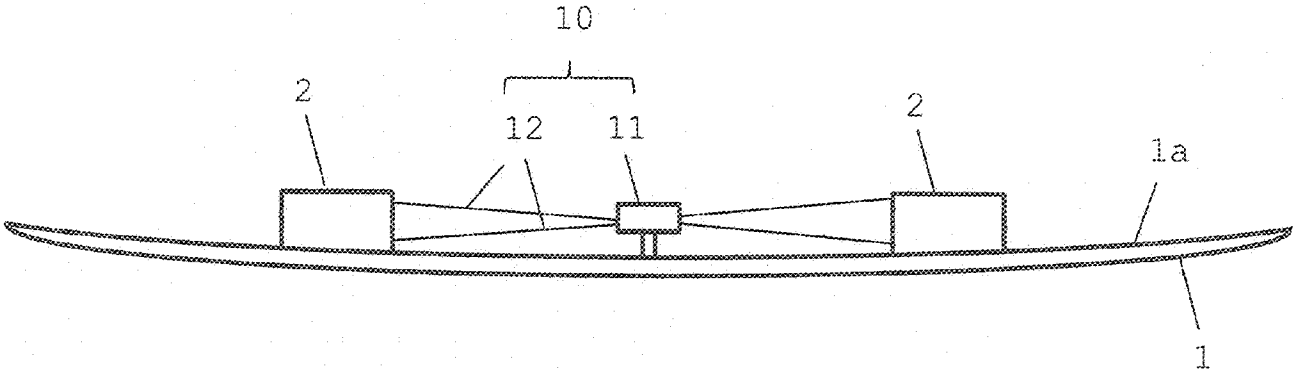
FIGS. 3*a* and 3*b* show a sports board according to another embodiment of the present invention.
Figure 3B:
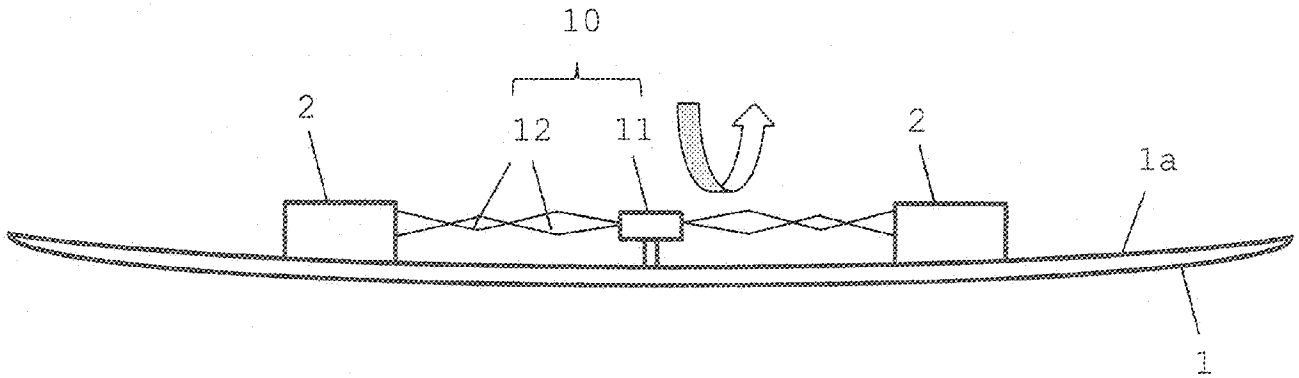

FIG. 3*a* and FIG. 3*b* show a further embodiment of the present invention with a tensioning device 10 for adjusting the tension on the at least one tensioning element 12 by rotation of the actuating device 11. At least two tensioning elements 12 are spanned from the actuating device 11 to each of the foot straps 2. In this embodiment, preferably at least two tensioning elements 12 are attached to each foot strap 2.

In FIG. 3*a*, the tensioning elements 12 are not yet rotated relative to each other. By rotating the actuating device 11 around the longitudinal axis of the sports board 1, the at least two tensioning elements 12 can be rotated on each side of the actuating device 11 against each other, as shown in FIG. 3*b*. Thus, the tensioning elements 12 are shortened, resulting in an increase of tensile stress on the tensioning elements 12. By reverse rotation of the actuating device 11, this tension on the tensioning elements 12 can be reduced accordingly.

Preferably, in this embodiment, the actuating device 11 can be locked in a plurality of rotary positions. For example, three locked positions of rotation are set up for the actuating device 11. For example, in a first rotary position the tensioning elements 12 are not rotated against each other to set a low flexural strength of the sports boards 1. In a second rotary position the tensioning elements 12 may be only slightly rotated against each other to set an average flexural strength of the sports boards 1. In a third rotary position the tensioning elements 12 may be strongly rotated against each other to set a high flexural strength of the sports boards 1.

In another embodiment of the present invention, the actuating device 11 comprises at least one part that is at least partially movable to vary its length in the longitudinal direction of the sports board 1. At least two tensioning elements 12 are mounted at this movable part, wherein each of the movable parts extends to one of the two foot straps 2. By varying the length of the movable part, a tensile stress at the at least one tensioning element 12 is increased or decreased.

Figure 4A:
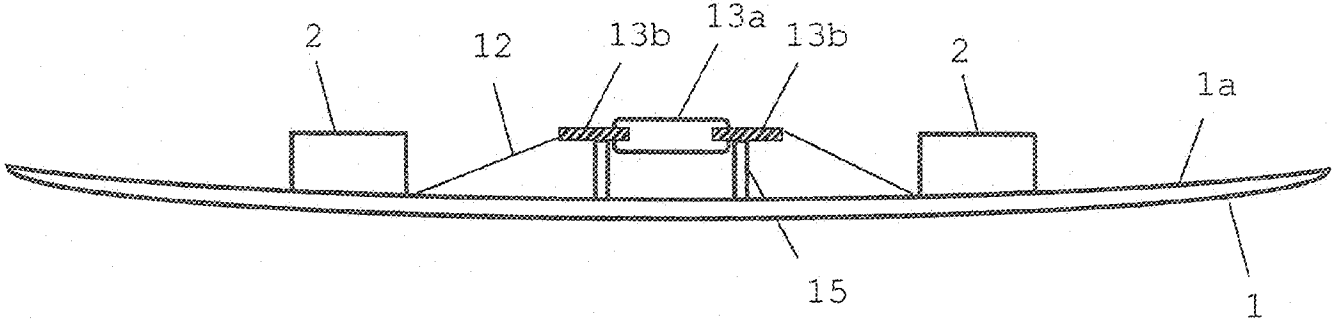
FIGS. 4*a* and 4*b* show a sports board according to another embodiment of the present invention.
Figure 4B:
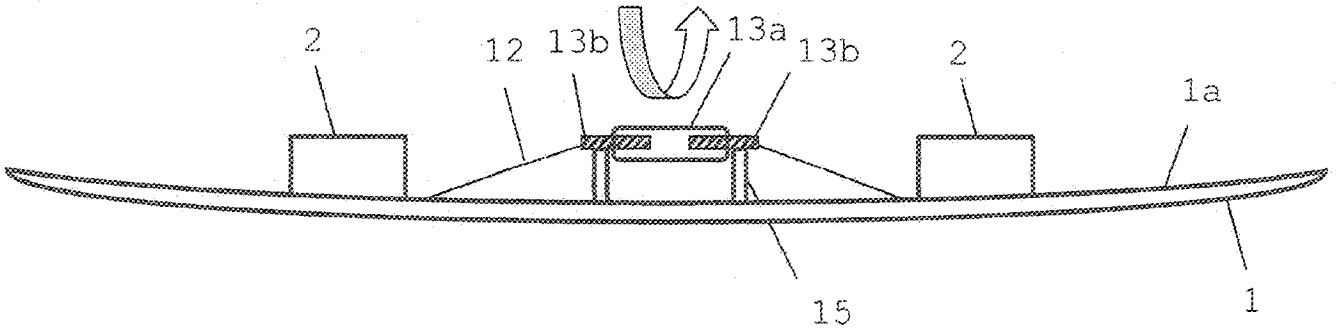

FIG. 4*a* and FIG. 4*b* in particular show such an actuating device 11, wherein the movable part consists of two threaded rods 13*b* and a turnbuckle 13*a*, wherein the turnbuckle 13*a* is arranged rotatably on the two threaded rods 13*b*. The turnbuckle 13*a* is rotated, and the threaded rod 13*b* is displaced in the longitudinal direction of the sports board 1. The threaded rods 13*b* are coupled to the turnbuckle 13*a* in such way that that a rotation of the turnbuckle 13*a* in a specific rotary direction causes screwing of both threaded rods 13*b* into the turnbuckle 13*a*, thereby reducing the length of the entire part. If the turnbuckle 13*a* is rotated in the opposite rotary direction the threaded rods 13*b* are screwed out of the turnbuckle 13*a* and the movable part is extended.

FIG. 4*a* shows a state in which the threaded rods 13*b* are protruded relatively far out of the turnbuckle 13*a* leading to a relatively small tension on the tensioning elements 12. In contrast, in FIG. 4*b* the turnbuckle 13*a* has been rotated which causes that the two threaded rods 13*b* are screwed into the turnbuckle 13*a*, and therefore are now protruded less far from the turnbuckle 13*a*, which results in a higher tension on the tensioning elements 12.

By rotating the turnbuckle 13*a*, also an extender wheel can be moved, generating a tension on the at least one tensioning element 12, wherein the extender wheel is adapted to lock in several, preferably in two or three positions.

Figure 4C:
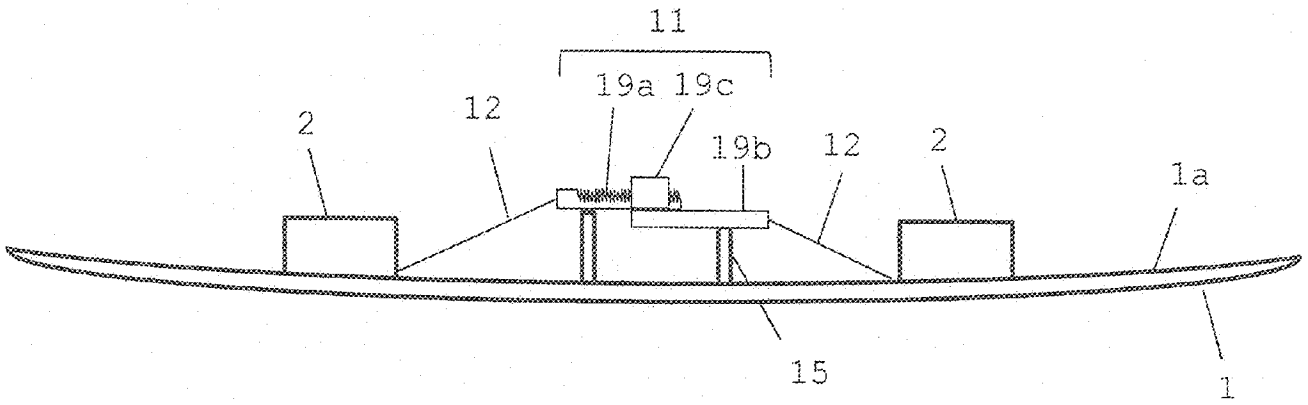
FIGS. 4*c* and 4*d* show a sports board according to another embodiment of the present invention.
Figure 4D:
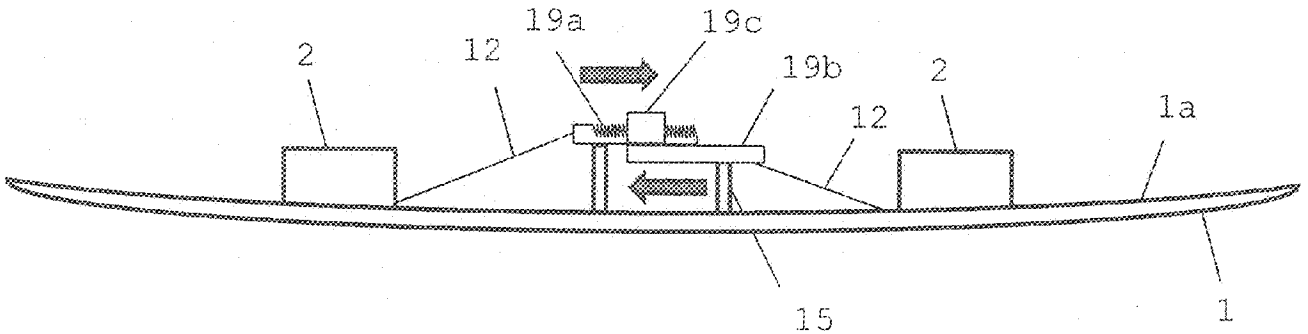

FIG. 4*c* and FIG. 4*d* in particular show an actuating device 11 comprising a movable part consisting of a toothed band 19 and a ratchet 19*b* which is designed with a buckle 19*c*, wherein the buckle 19*c* is connected to the top face of the ratchet 19*b*. The toothed band 19*a* is at least partially led through the buckle 19*c*, such that a part of the toothed band 19*a* extends over the top face of the ratchet 19*b* in an at least partly overlapping manner. By actuating the buckle 19*c*, the ratchet 19*b* can be shifted against the toothed band 19*a* in the longitudinal direction of the sports board 1 and can be locked by gearing into the toothing of the toothed band 19*a*. Preferably, the buckle 19*c* is connected with the top of the ratchet 19*b* such that it can be lifted and lowered and is in contact with the toothed band 19*a* such that by lifting and lowering of the buckle 19*c* the ratchet 19*b* is moved in the opposite direction of the toothed band 19*a*, whereby the length of the actuating device 11 is reduced in longitudinal direction of the tensioning device 10 and the tensioning stress on the tensioning elements 12 is increased. If the ratchet 19*b* is released, for example by actuation of the buckle 19*c*, and a pulling force is simultaneously applied to the toothed band 19*a*, for example by tensioning of the sports board 1, the toothed band 19*a* and the ratchet 19*b* move apart in the longitudinal direction of the tensioning device 10, i.e. in the longitudinal direction of the sports board 1, and the movable part of the actuating device 11 is extended.

FIG. 4*c* shows a state in which the toothed band 19*a* and the ratchet 19*b* are displaced relatively little, so that an overlapping of the toothed band 19*a* and the ratchet 19*b* occurs only in a relatively small area leading to a relatively small tension on the tensioning elements 12. In contrast, in FIG. 4*d* the buckle 19*c* has been actuated, so that the toothed band 19*a* has been displaced in the longitudinal direction of the sports board 1 against the ratchet 19*b*, so that the overlap of these two parts is increased and the tension on the tensioning elements 12 is therefore higher. The top arrow shows the direction of movement of the toothed band 19*a*, whereas the lower arrow indicates the direction of movement of the ratchet 19*b* to the buckle 19*c*.

Figure 5A:
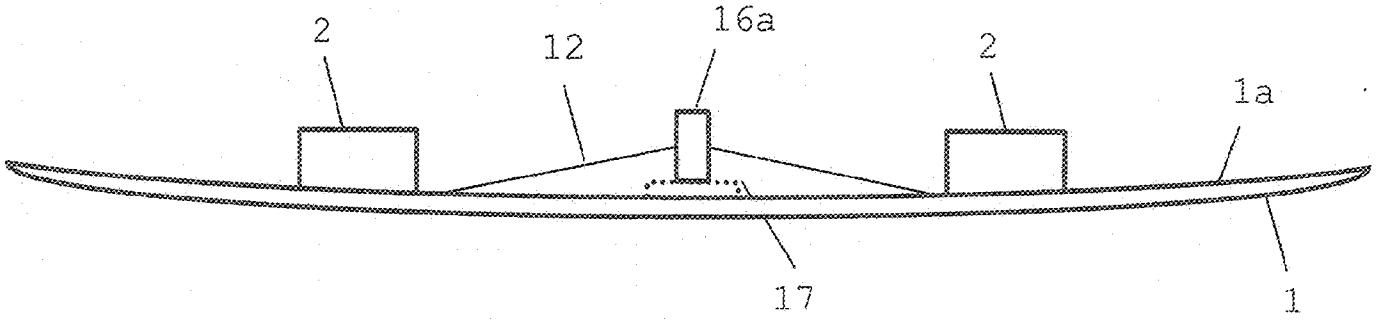
FIGS. 5*a* and 5*b* show a sports board according to another embodiment of the present invention.
Figure 5B:
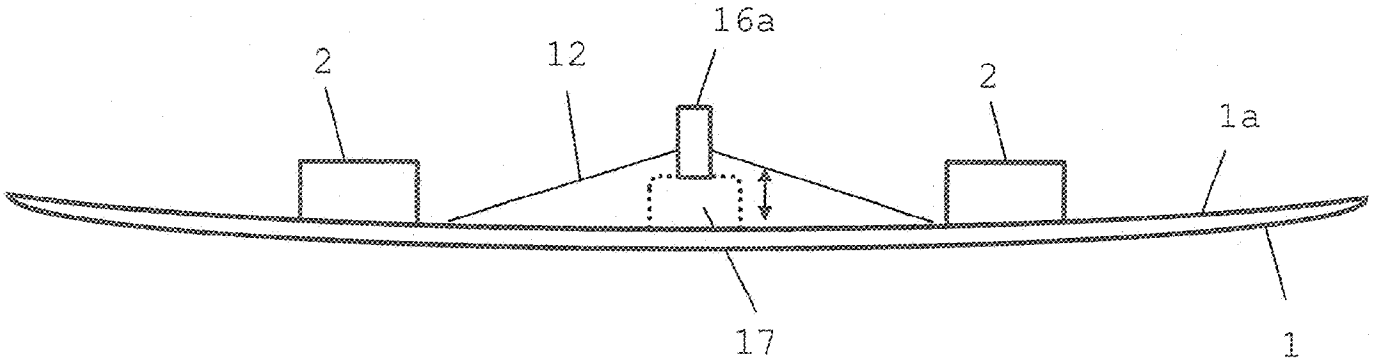

FIG. 5*a* and FIG. 5*b* show a further embodiment of the present invention, wherein a tension on the at least one tensioning element 12 is adjustable by varying the height of a height-adjustable part of the actuating device 11. For example, in FIG. 5*a* and FIG. 5*b*, the at least one tensioning element 12 is connected to a height-adjustable part 16*a* of the actuating device 11, which is located on an air cushion 17. The air cushion 17 can be actuated by introducing or releasing air. FIG. 5*a* shows a state in which the air cushion 17 contains little air, so that the part 16*a* is closer to the upper surface 1*a* of the sports board 1. In FIG. 5*b*, however, the air cushion 17 is more inflated, so that the portion 16*a* is disposed higher on the upper surface 1*a*. The part 16*a* exerts a tension on the at least one tensioning element 12.

Figure 6A:
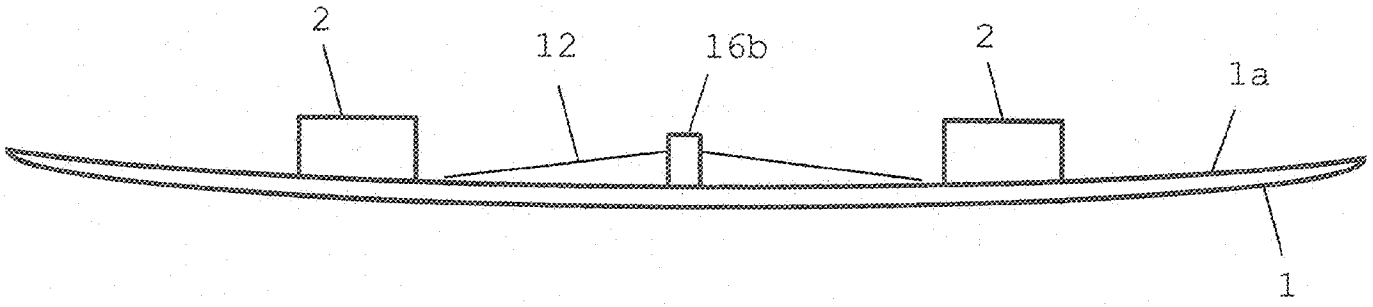
FIGS. 6*a* and 6*b* show a sports board according to another embodiment of the present invention.
Figure 6B:
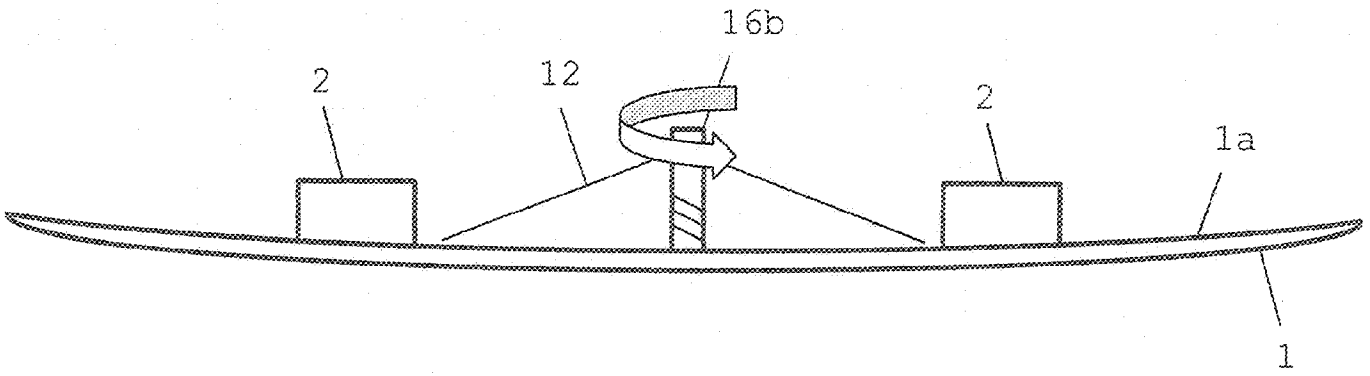

FIG. 6*a* and FIG. 6*b* show a further embodiment of the present invention, wherein a screw 16*b* is screwed into the upper surface 1*a* of the sports board 1. By actuating the screw 16*b*, i.e. screwing or unscrewing of screw 16*b*, the length of that portion of the screw 16*b* is changed, which protrudes from the sports board 1. The at least one tensioning element 12 is preferably mounted on top of the screw 16*b*. Thus, by screwing or unscrewing the screw 16*b* on the upper surface 1*a* of the sports board 1, the tension on the at least one tensioning element 12 is varied. The lower part of FIG. 7 illustrates a plan view of a tensioning device 10 according to the present invention. As shown in FIG. 6, a screw 16*b* can for instance be used to change a tension on the at least one tensioning element 12. FIG. 7 particularly shows that either, at least one tensioning element 12 is extended from each foot strap 2 to the actuating device 11 and is bent at the actuating device 11, or at least two tensioning elements 12 are extended between each foot strap 2 and the actuating device 11. The ends of the tensioning elements 12 are each connected to at least two points 18 adjacent to each foot strap 2 of the upper surface 1*a* of the sports board 1. Thus, a triangular shape is defined by the tensioning elements 12 extending between the actuating device 11 and each foot strap 2. Preferably, the actuating device 11 is located centrally in the transverse direction Q of the sports board 1 and, preferably, the points 18 are placed with an offset to each other in the transverse direction Q of the sports board 1. Not only the flexural strength of the sports board 1 but also the torsional stiffness can be adjusted by changing the tension on the tensioning elements 12, wherein the torsional stiffness is the ability of the sports board 1 to twist about its longitudinal axis.

Figures 7A, 7B:
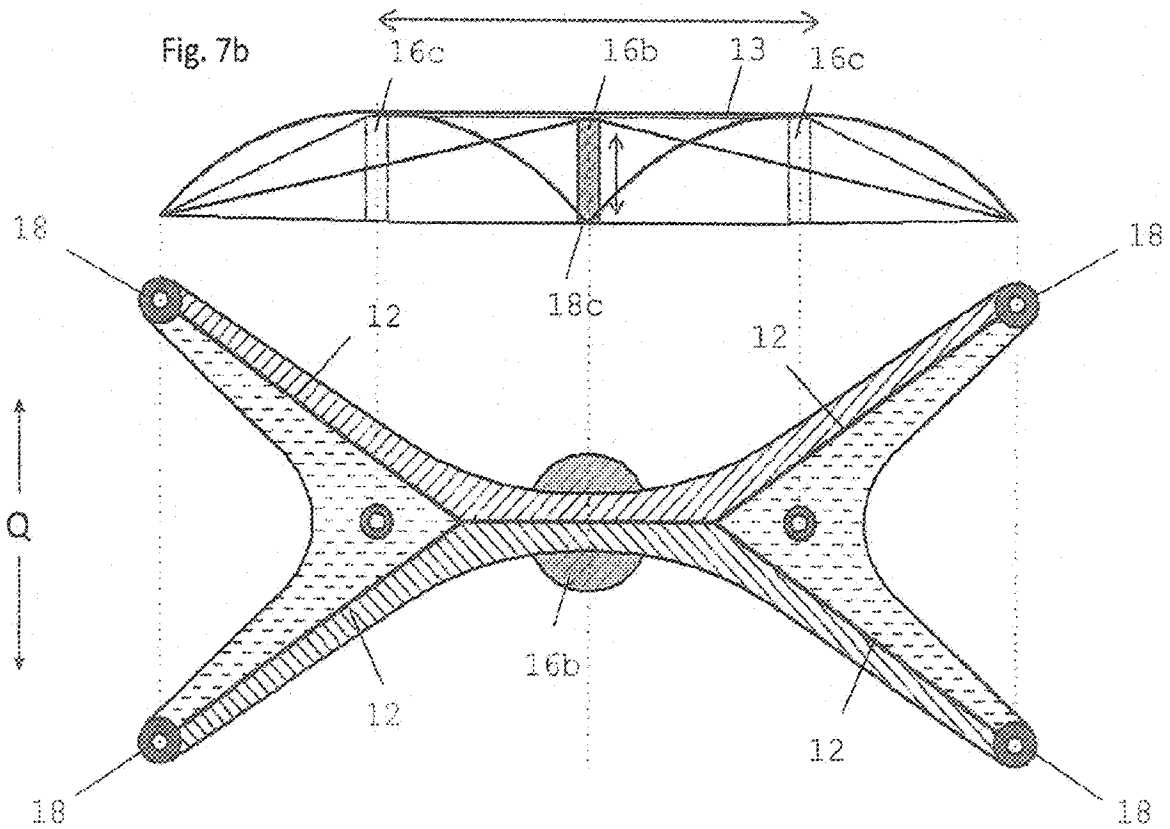
FIG. 7*a* shows a top view of a tensioning device of a sports board according to an embodiment of the present invention.
FIG. 7*b* shows a side view thereof.

FIGS. 7*a* and 7*b* show several embodiments of a tensioning device 10, wherein the at least one tensioning element 12 as described above extends between a screw 16*b* and two points 18 adjacent to the foot straps 2 at the upper surface 1*a* of the sports boards 1. Alternatively, the at least one tensioning element 12 is tensioned by means of two screws 16*c* and an intermediate attachment point 18*c*.

Figure 8:
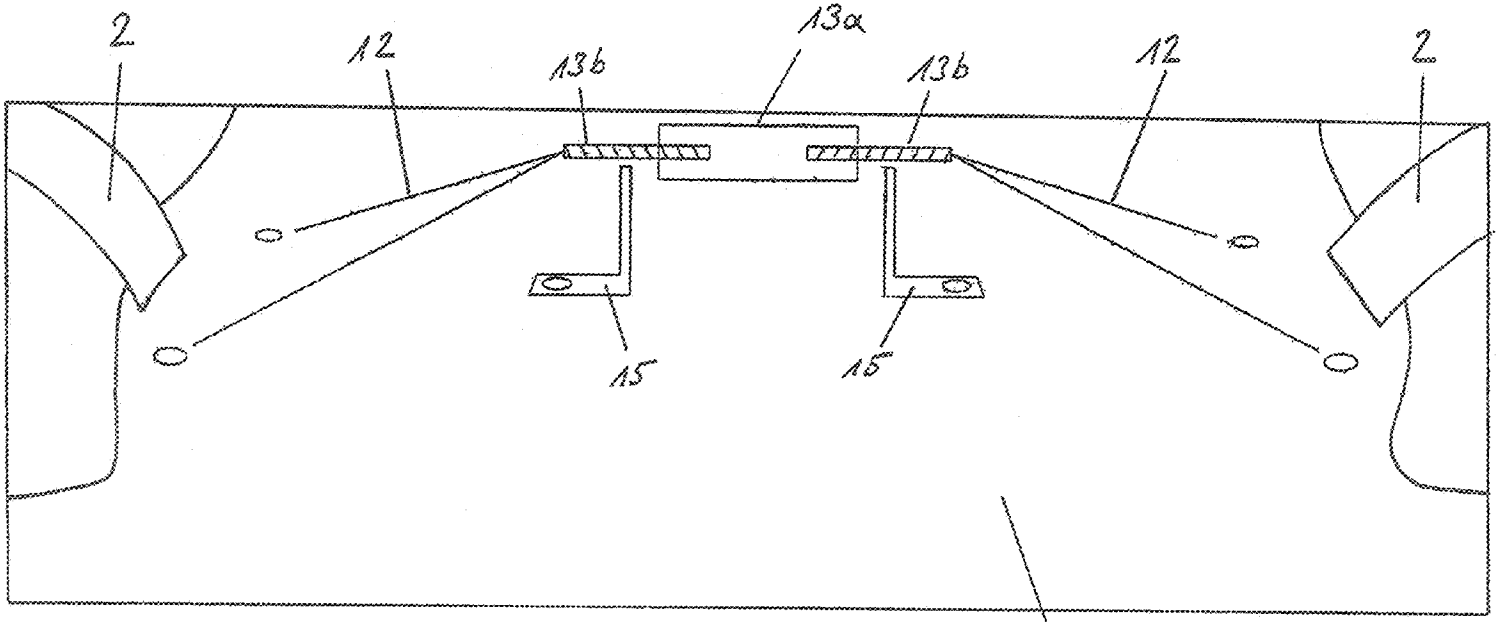
FIG. 8 shows an example of a sports board of the present invention.

FIG. 8 illustrates a sports board 1 and tensioning device 10 according to the embodiment described above, with a turnbuckle 13 and two threaded rods 13*b*. The turnbuckle 13*a* and the threaded rods 13*b* are held by a holding device 15 above the upper surface 1*a* of the sports board 1. Starting from each threaded rod 13*b* a tensioning element 12 extends in the direction of a foot strap 2. Each of the tensioning elements 12 is bent at a threaded rod 13*b* and secured with two points 18 on the upper surface 1*a*. Thus, as shown in FIG. 7, a triangular shape is defined by the tensioning elements 12 and a foot strap 2. By actuating the turnbuckle 13*a* the rider can adjust both the flexural strength and torsional stiffness of the sports boards 1.

Figure 9:
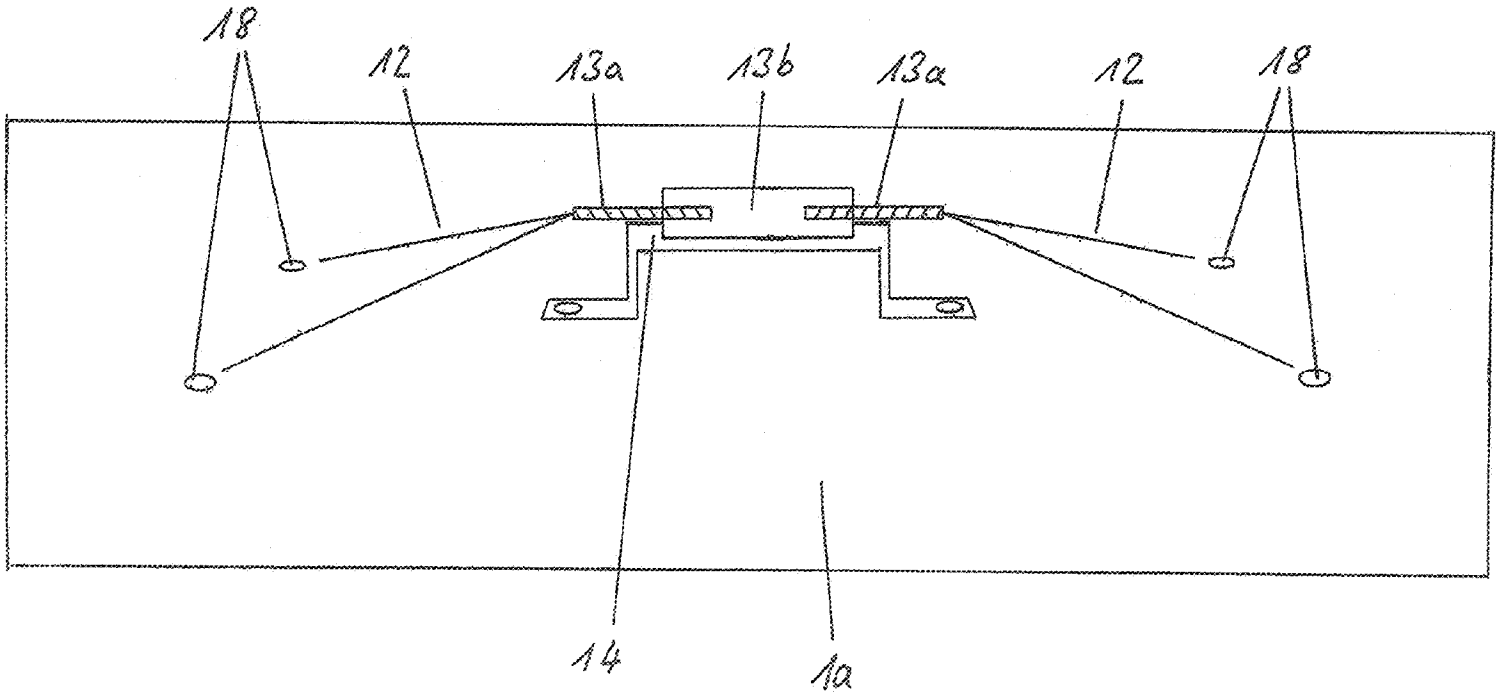
FIG. 9 shows an example of a sports board of the present invention.

FIG. 9 shows the actuating device 11 of FIG. 8 placed on a grab handle 14 of the sports board 1. The entire tensioning device 10 can be covered, for example with a plastic material, in particular foam or rubber material in order to prevent an injury of the rider. The turnbuckle 13*a* can be integrated in the grab handle 14 so that it can be actuated by rotation of at least a portion of the handle 14.

Figure 10A:
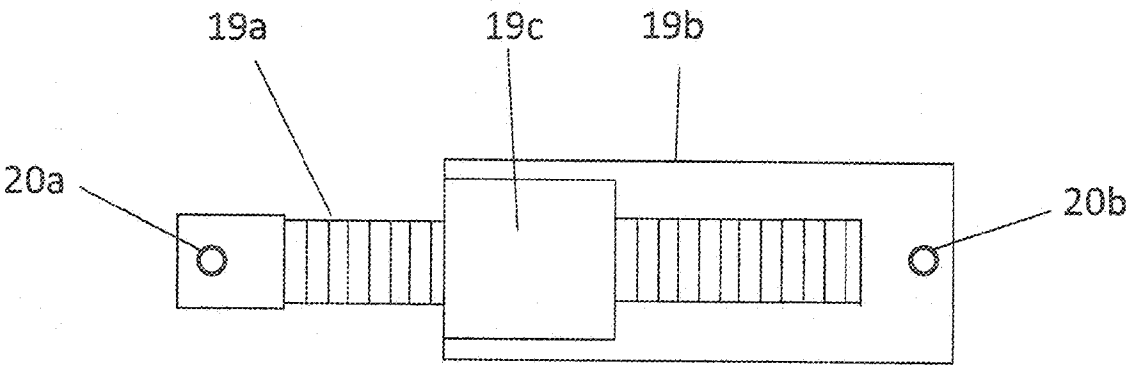
FIGS. 10*a* and 10*b* show a tensioning device of a sports board according to an embodiment of the present invention.
Figure 10B:
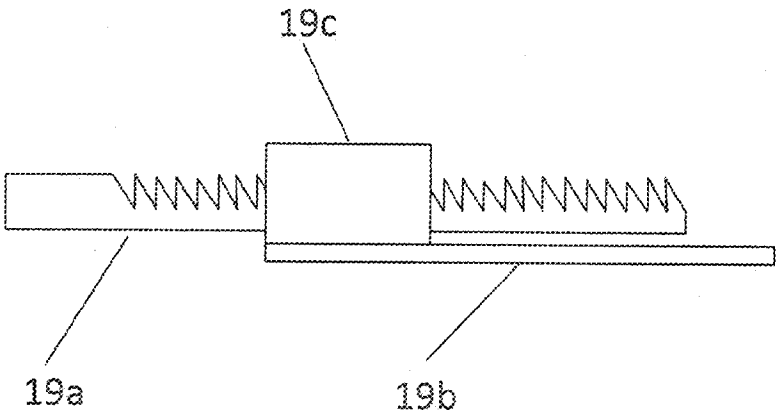

FIG. 10*a* shows a plan view and FIG. 10*b* shows a side view of a further actuating device 11 according to the present invention, in which—as shown in FIG. 4*c* and FIG. 4*d*—the movable part consists of a toothed band 19 and a ratchet 19*b* with a buckle 19*c*. The buckle 19*c* is movably connected to the upper surface 19*c* of the ratchet 19*b* by a connecting joint, so that it can be lifted and lowered, and the toothed band 19*a* is at least partially passed through the buckle 19*c*. As can be seen from FIG. 10*b*, a part of the toothed band 19*a* is at least partially overlapping with the ratchet 19*b*.

FIG. 10*a* also shows the mounting portion 20*a* of the at least one tensioning element 12 which extends from the toothed band 19*a* to the first foot strap 2 (not shown), as well as the fixing portion 20*b* for the at least one tensioning element 12, from which ratchet 19*b* extends to the second foot strap 2 (not shown).

Figure 11:
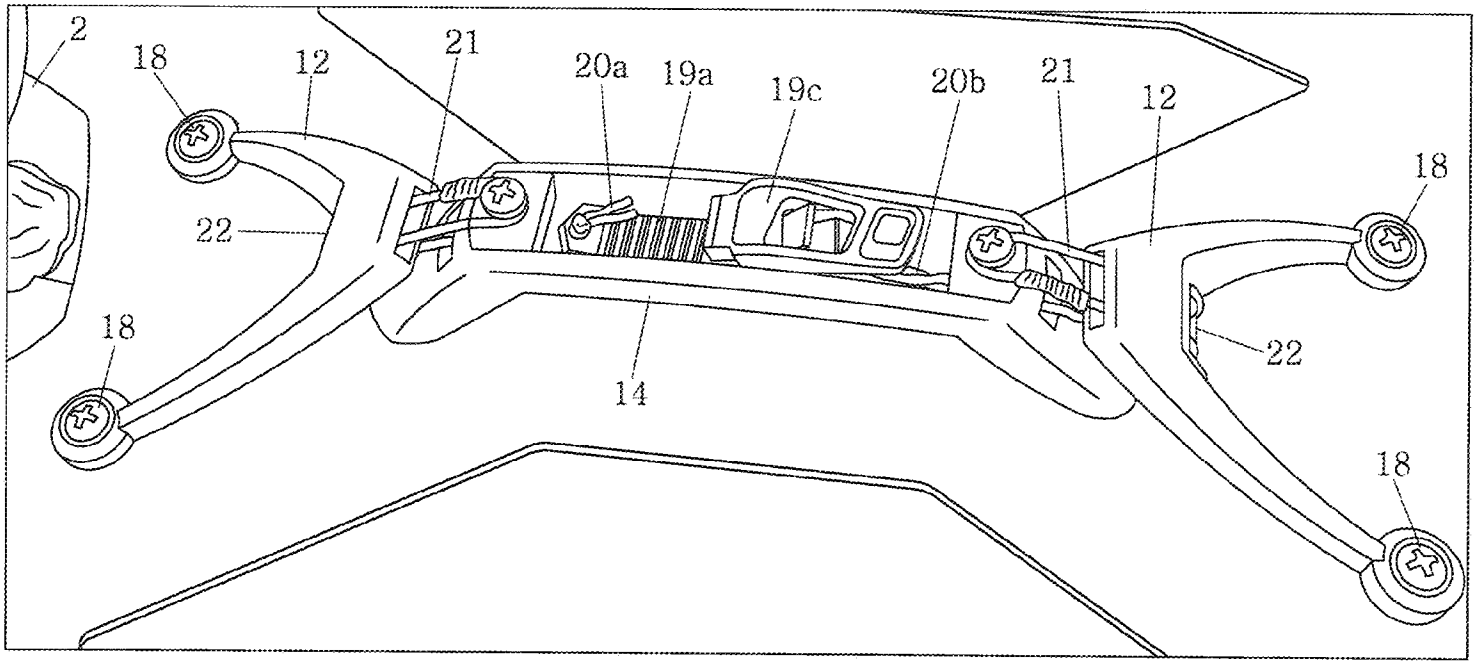
FIG. 11 shows a tensioning device of a sports board according to an embodiment of the present invention.

FIG. 11 shows a picture of a tensioning device 10 according to the embodiment described above with a toothed band 19*a* and a ratchet 19*b* (not shown) with a buckle 19*c*. In particular, FIG. 11 shows the integration of the actuating device 11 according to FIG. 10*a* and FIG. 10*b* into the grab handle 14 of the sports board 1. Here, a preferred embodiment of the invention is shown, in which the actuating device 11 is integrated into a longitudinal cavity of the grab handle 14. The rider obtains full access to the tensioning device 11, wherein at the same time the risk of injury is minimized by deepening the tensioning device into the cavity of the grab handle 14.

Starting from the toothed band 19*a* and the ratchet 19*b* a particular tensioning band 21 extends to a particular tensioning element 12 in the direction of one foot strap 2. The tensioning band 21 is connected to the respective tensioning element 12 via a redirection element 22. Here, the redirection element 22 is formed as an integral part of the tensioning element 12. Each of the tensioning elements 12 is fixed on the upper surface 1*a* of the sports board 1 at two points 18. Thus, as shown in FIG. 7*a* triangular shape is defined by the tensioning elements 12 and a foot strap 2. By actuating the buckle 19*c*, the rider can adjust both the flexural strength and torsional stiffness of the sports board 1.

Figure 12:
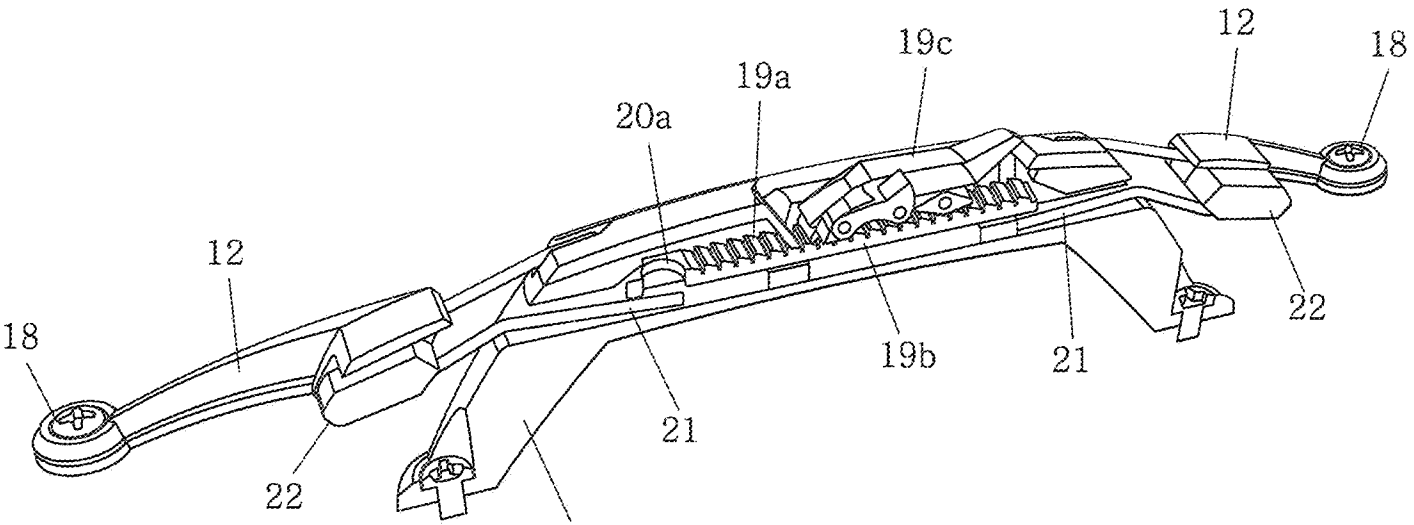
FIG. 12 shows a tensioning device of a sports board according to an embodiment of the present invention.

FIG. 12 shows a further preferred embodiment of a tensioning device 10 according to the invention in longitudinal section. The actuating device 11 of this tensioning device 10 comprises a toothed band 19*a* and a ratchet 19*b* with a buckle 19*c*, wherein the ratchet 19*b* is fixedly connected with a holding device 15, namely a grab handle 14 of the sports board 1 or fixed to it.

In the shown embodiment the toothed band 19*a* and the ratchet 19*b* are connected to the respective tensioning element 12 by means of a tensioning band 21. Herein, the tensioning band 21 is formed as a loop, which interconnects the toothed band 19*a* and the ratchet 19*b*. In this case, one end of the loop of the tensioning band 21 is fixed at a fixing region 20*a* of the toothed band 19*a* and the other end of tensioning band 21 is fixed at a fixing region 20*b* of the ratchet 19*b* (not shown). Here, the tensioning band 21 extends from the toothed band 19*a*/20*a* on the one side, and from the ratchet 19*b*/20*b* on the other side in the direction of the respective tensioning element 12 and is guided around by a redirection element 22 on both sides. Thus, the actuating device 11 is connected to the tensioning elements 12 via a loop-shaped tensioning band 21 and two redirection elements 22. The redirection elements 22 are integral parts of the tensioning elements 12. Each of the tensioning elements 12 can be fixed at two points 18 on the upper surface 1*a* of a sports board 1.

By actuating the buckle 19*c*, the toothed band 19 is moved in the longitudinal direction of the sports board 1 against the ratchet 19*b*. However, the ratchet 19*b* with the buckle 19*c* does not change its absolute position, since it is fixedly connected to the holding device 15, here the grab handle 14. This leads to a shortening of the tensioning band 21 such that the tensile stress on the tensioning elements 12 increases. The redirection elements 22 act as a double pulley, which facilitates actuation of the ratchet 19*b* and reduces the forces on the toothed band 19*a*.

Furthermore, in one embodiment, the present invention provides a sports board 1, preferably kiteboard or wakeboard, with an adjustable flexural strength, comprising a tensioning device 10 arranged between two foot straps 2, wherein the foot straps 2 are attached on an upper surface 1*a* of the sports board 1, the tensioning device 10 comprising: a central actuating device 11, and at least one tensioning element 12 extending from said actuating device 11 to both of the foot straps 2, wherein the tensioning element 12 is connected either with the upper surface 1*a* of the sports board 1 near the foot straps 2, or with the foot straps 2, wherein a tension on the at least one tensioning element 12 is adjustable by means of the actuating device 11.

In this embodiment, the actuating device 11 advantageously includes at least one tensioning element 12 which can be tensioned along its extension direction by means of the actuating device 11, wherein the actuating device 11 comprises at least one turnbuckle or cable tensioner.

In this embodiment it is also advantageous that the actuating device 11 is rotatable such that the at least one tensioning element 12 can be rotated around its extension direction, and the tension on the at least one tensioning element 12 is adjustable by rotating the actuating device 11. Preferably, the actuating device 11 can be locked at least in a plurality of positions, more preferably wherein the actuating device 11 can be continuously locked.

In the above embodiment, it is also advantageous that a movable part 13, 13*a*, 13*b* of the actuating device 11 is designed to vary its length in longitudinal direction L of the sports board 1, at least one tensioning element 12 extends from said movable part 13, 13*a*, 13*b* to each foot strap 2, and the tension on the at least two tensioning elements 12 is adjustable by varying the length of the movable part 13, 13*a*, 13*b*.

In the above embodiment, it is also advantageous that the actuating device 11 comprises a turnbuckle 13*a* and two threaded rods 13*b*, at least one tensioning element 12 extends from each threaded rod 13*b* to a foot strap 2, and the tension on the at least two tensioning elements 12 is adjustable by rotating the turnbuckle 13*a*.

It is also preferable that the turnbuckle 13*a* and the threaded rods 13*b* are held above the upper surface 1*a* of the sports board 1 by at least one holding device 15, preferably 1-10 cm, more preferably 2.5-6 cm above the upper surface 1*a* of the sports board 1.

In the above embodiment, it is further advantageous that a movable part 16*a*, 16*b* of the actuating device 11 is designed to vary its height above the upper surface 1*a* of the sports board 1, at least one tensioning element 12 extends from said movable part 16*a*, 16*b* to each foot strap 2, and the tension on the at least two tensioning elements 12 is adjustable by varying the height of the movable part 16*a*, 16*b*.

It is further preferred that an air cushion 17 is arranged between the upper surface 1*a* of the sports board 1 and the movable part 16*a*, wherein the height of the movable part 16*a* on the upper surface 1*a* of the sports board 1 is adjustable by introducing air into the air cushion 17 or releasing air from the air cushion 17.

In the above embodiment, it is also advantageous that the actuating device 11 comprises a screwing device 16*b*, which is screwed into the upper surface 1*a* of the sports boards 1, at least one tensioning element 12 extends from the screwing device 16*b* to each foot strap 2, and the tension on the at least two tensioning elements 12 is adjustable by turning the screwing device 16*b*.

In the above embodiment, it is also advantageous that at least two tensioning elements 12 extend to each foot strap 2 and are connected at two points 18 either with the upper surface 1*a* of the sports board 1 or with the foot strap 2, or at least one tensioning element 12 which is bent at the actuating device 11 extends to each foot strap 2 and is connected at two points 18 either with the upper surface 1*a* of the sports board 1 or with the foot strap 2, wherein the two points 18 are arranged with an offset to each other in the transverse direction Q of the sports board 1. It is further preferred that the actuating device 11 is arranged approximately in the middle of the transverse direction Q of the sports board 1.

In the above embodiment, it is furthermore advantageous that the sports board 1 comprises a handle 14 attached to its upper surface 1*a*, wherein the handle 14 carries or incorporates the actuating device 11.

In the above embodiment, it is furthermore advantageous that the at least one tensioning element 12 is designed such that the tension on the at least one tensioning element 12 can be tensile stress and/or shear stress.

In the above embodiment, it is furthermore advantageous that the at least one tensioning element 12 is a rope and/or is made of plastic.

In the above embodiment, it is also advantageous in that the actuating device 11 and the at least one tensioning element 12 are integrally formed from a plastic part.

In each embodiment, the flexural strength of the sports board 1 can be adjusted in a simple and fast manner by the rider itself. Therefore, the rider can react quickly to changing conditions during the use of the sports board 1.

In summary, the present invention describes several embodiments of a sports board 1, preferably a kiteboard or a wakeboard, with adjustable flexural strength. In each embodiment, the sports board 1 comprises a tensioning device 10 which is arranged between two foot straps 2 mounted on an upper surface 1*a* of the sports board 1. In each embodiment, the tensioning device 10 consists of at least a central actuating device 11 and at least one tensioning element 12 which extends from the actuating device 11 to both foot straps 2 or near the foot straps 2 on the upper surface 1*a* of the sports board 1. In each embodiment, a tension on the at least one tensioning element 12 is varied by the actuating device 11.

All embodiments of the present invention that are illustrated, claimed or described herein may be combined with each other unless they are conflicting.

I claim:

1. A sports board for water sports, comprising:

said sports board having an adjustable flexural strength;

said sports board having an upper surface and two foot enclosures disposed in spaced relation thereon;

a tensioning device attached to said upper surface;

said tensioning device including an actuating device and at least one tensioning element, said tensioning element being adjustable by means of said actuating device; and said actuating device being elevated above said upper surface;

whereby the flexural strength of said sport board may be adjusted by actuation of said actuating device.

2. The sports board of claim 1, further comprising:

said tensioning element being extendable;

said actuating device controlling the tension of said tensioning element; and said actuating device including at least one of a turnbuckle and a cable tensioner.

3. The sports board of claim 1, wherein said actuating device is disposed between said foot enclosures.

4. The sports board of claim 1, wherein said least one tensioning element can be tensioned along its extension direction by said actuating device, wherein said actuating device comprises a toothed band and a ratchet.

5. The sports board of claim 1, wherein said actuating device is rotatable such that tension on the at least one tensioning element is adjustable by rotating the actuating device.

6. The sports board of claim 1, wherein said actuating device includes a movable part which varies its length in longitudinal direction of the sports board, and at least one tensioning element extending from said movable part to each of said foot enclosures, and wherein the tension on each of said tensioning elements is adjustable by varying the length of the movable part.

7. The sports board according to claim 1, wherein said actuation device includes a turnbuckle in threaded engagement with two threaded rods, at least one tensioning element extending from each of said threaded rods to a foot enclosure, wherein the tension on each of said tensioning element is adjustable by turning the turnbuckle.

8. The sports board according to claim 1, wherein said actuating device comprises a toothed band and a ratchet, and wherein said at least one tensioning element includes a first tensioning element extending from said toothed band to one of said pair of foot enclosures, and a second tensioning element extending from said toothed band to the other one of said pair of foot enclosures, and wherein the tension on said first and second tensioning elements is adjustable by user actuation of said ratchet.

9. The sports board according to claim 8, wherein said toothed band and said ratchet are each connected to said first and second tensioning elements by corresponding first and second tensioning bands.

10. The sports board according to claim 1 wherein said actuating device includes a movable part configurable to various heights above the upper surface of said sports board, and at least one tensioning element extending from said movable part to each of said foot enclosures, and wherein the tension on each of said tensioning elements being adjustable by varying the height of said movable part.

11. The sports board according to claim 10, further including an air cushion disposed between said movable part and the upper surface of said sports board, and wherein the height of the said movable part relative to the upper surface of said sports board is adjusted by introducing air into said air cushion or releasing air from said air cushion.

12. The sports board according to claim 1, wherein said actuating device comprises a threaded screw device which is in threaded engagement with the upper surface of said sports board with at least one tensioning element extending from said screw device to each of said foot enclosures, and wherein the tension on said tensioning elements is adjustable by turning said threaded screw device.

13. The sports board according to claim 1 further including a handle attached said sports board with said actuating device incorporated with said handle.

14. A sports board for water sports, comprising:

said sports board having an upper surface and two foot enclosures disposed in spaced relation thereon;

a tensioning device attached to said upper surface;

said tensioning device including an actuating device and at least one tensioning element;

said tensioning element being adjustable by means of said actuating device; and said actuating device being elevated above said upper surface; and wherein the curvature of the sports board is adjusted by actuation of said actuating device.

15. The sports board of claim 14, further comprising:

said tensioning element being extendable;

said actuating device controlling the tension of said tensioning element; and said actuating device including at least one of a turnbuckle and a cable tensioner.

* * * * *